US012270320B2

(12) United States Patent
Allam

(10) Patent No.: US 12,270,320 B2
(45) Date of Patent: Apr. 8, 2025

(54) $CO_2$ POWER CYCLE WITH ADIABATIC COMPRESSION

(71) Applicant: 8 Rivers Capital, LLC, Durham, NC (US)

(72) Inventor: Rodney John Allam, Chippenham (GB)

(73) Assignee: 8 Rivers Capital, LLC, Durham, NC (US)

( * ) Notice: Subject to any disclaimer, the term of this patent is extended or adjusted under 35 U.S.C. 154(b) by 0 days.

(21) Appl. No.: 18/710,723

(22) PCT Filed: Nov. 17, 2022

(86) PCT No.: PCT/IB2022/061111
§ 371 (c)(1),
(2) Date: May 16, 2024

(87) PCT Pub. No.: WO2023/089540
PCT Pub. Date: May 25, 2023

(65) Prior Publication Data
US 2025/0052177 A1 Feb. 13, 2025

Related U.S. Application Data

(60) Provisional application No. 63/280,790, filed on Nov. 18, 2021.

(51) Int. Cl.
*F01K 25/10* (2006.01)
*F01K 11/02* (2006.01)
*F01K 25/14* (2006.01)

(52) U.S. Cl.
CPC ..... *F01K 25/103* (2013.01); *F01K 11/02* (2013.01); *F01K 25/14* (2013.01)

(58) Field of Classification Search
CPC ..... F01K 25/103; F01K 11/02; F01K 25/14
See application file for complete search history.

(56) References Cited

U.S. PATENT DOCUMENTS 6,260,348 B1 * 7/2001 Sugishita ..... C01B 3/32 60/39.12
6,269,624 B1 * 8/2001 Frutschi ..... F02C 1/06 60/39.52
7,089,743 B2 * 8/2006 Frutschi ..... F02C 1/10 60/39.52

(Continued)

FOREIGN PATENT DOCUMENTS

EP 3167175 B1 11/2019

OTHER PUBLICATIONS

Preliminary Cost and Performance Results for a Natural Gas Fired Direct SCO2 Power Plant, 6th International Supercritical CO2 Power Cycles Symposium, Year: 2018.*

*Primary Examiner* — Jesse S Bogue
(74) *Attorney, Agent, or Firm* — Womble Bond Dickinson (US) LLP

(57) ABSTRACT

The present disclosure relates to systems and methods useful for power production. In particular, a power production cycle utilizing $CO_2$ as a working fluid may be combined with a second cycle wherein a compressed $CO_2$ stream from the power production cycle, which can be heated and expanded to produce additional power and to provide additional heating to the power production cycle.

11 Claims, 1 Drawing Sheet

(56) References Cited

U.S. PATENT DOCUMENTS

| | | | | |
|---|---|---|---|---|
| 8,776,532 | B2 * | 7/2014 | Allam | F25J 3/04563<br>60/39.464 |
| 9,850,815 | B2 * | 12/2017 | Allam | F02C 3/04 |
| 10,047,673 | B2 * | 8/2018 | Allam | C01B 32/60 |
| 10,415,434 | B2 * | 9/2019 | Allam | F02C 3/34 |
| 10,746,461 | B2 * | 8/2020 | Allam | F25J 3/04018 |
| 10,914,232 | B2 * | 2/2021 | Allam | F01K 25/103 |
| 11,174,759 | B2 * | 11/2021 | Allam | F01K 7/16 |
| 11,231,224 | B2 * | 1/2022 | Allam | F25J 1/0032 |
| 11,939,915 | B2 * | 3/2024 | Uechi | C01B 3/04 |
| 2018/0058318 | A1 * | 3/2018 | Allam | F25J 3/04066 |
| 2019/0271266 | A1 | 9/2019 | Allam | |
| 2021/0115849 | A1 | 4/2021 | Forrest et al. | |
| 2024/0200492 | A1 * | 6/2024 | Ferner | F02C 3/34 |

* cited by examiner

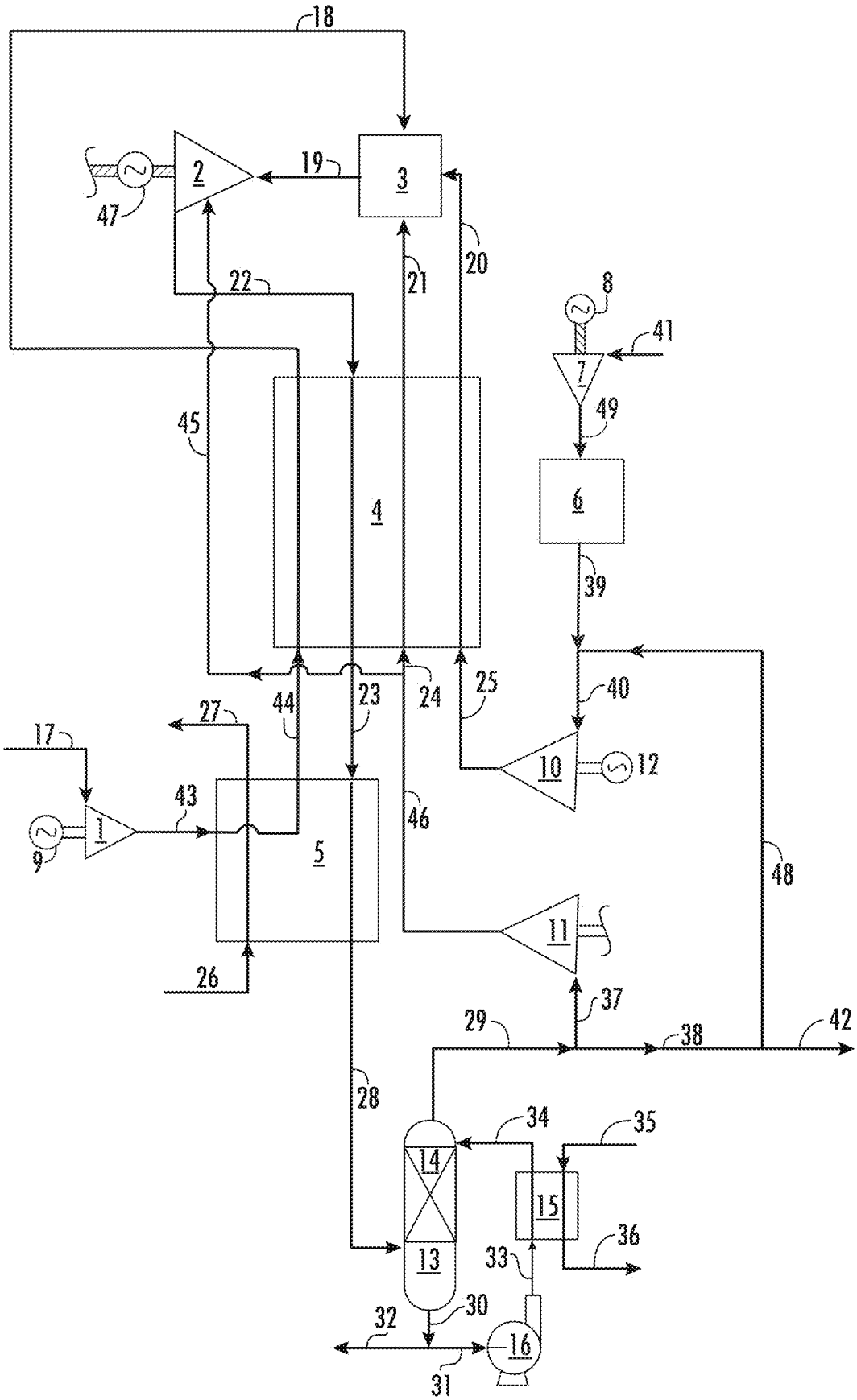
18
19
2
3
47
20
21
22
8
41
7
49
45
4
6
39
44
23
24
25
40
27
17
10
12
43
46
1
9
5
48
11
26
37
29
38
42
28
34
35
14
15
36
13
33
30
32
16
31

$CO_2$ POWER CYCLE WITH ADIABATIC COMPRESSION

CROSS-REFERENCE TO RELATED APPLICATIONS

The present application is a U.S. National Stage of International Patent Application PCT/IB2022/061111, filed Nov. 17, 2022, and claims priority to U.S. Provisional Patent Application No. 63/280,790, filed Nov. 18, 2021. The disclosures of each of the applications noted above are incorporated herein by reference in their entirety.

FIELD OF THE INVENTION

The present disclosure provides power production systems and methods wherein a power production cycle utilizing a $CO_2$ circulating fluid can be improved in its efficiency. In particular, a compressed $CO_2$ stream from the power production cycle can be heated with an independent heat source and expanded to produce additional power and to provide additional heating for one or more secondary processes.

BACKGROUND

A primary objective for power generation using naturally occurring hydrocarbon and carbonaceous fuels such as natural gas and coal is to achieve a high thermal efficiency, near 100% capture of $CO_2$ derived from the oxidation of carbon present in the fuel with low capital cost and reliable operating characteristics. The global requirement for the elimination of anthropogenic $CO_2$ emission to the atmosphere to prevent damaging global warming cannot be achieved by a combination of nuclear and renewable wind and solar based power generation alone. It may be necessary to introduce high efficiency fossil fuel-based power generation systems with 100% $CO_2$ capture together with effective geological storage of $CO_2$ on a massive scale to reach global targets for elimination of $CO_2$ emissions.

A power cycle using a circulating $CO_2$ stream as the working fluid in a power turbine is described in U.S. Pat. No. 8,596,075 to Allam et al., the disclosure of which is incorporated herein by reference. The cycle is a recuperative supercritical Brayton cycle with a combination of cooling, recycle compression and high-density fluid pumping to re-circulate the $CO_2$ working fluid stream. One embodiment uses a preheated recycled $CO_2$ stream at about 300 bar (30 MPa) pressure, which is heated by mixing with the combustion products of natural gas fuel and substantially pure oxygen to produce the inlet flow at about 1150° C. to a power turbine which has an outlet pressure of about 30 bar (3 MPa). The turbine outlet flow at about 720° C. is cooled to near ambient temperature while heating the high pressure recycle $CO_2$ to about 700° C. in a recuperative heat exchanger. The cooled turbine exhaust leaving the recuperative heat exchanger is further cooled to near ambient temperature and condensed water derived from oxidation of hydrogen in the fuel is removed. The $CO_2$ remaining is compressed to about 300 bar (30 MPa) and the net $CO_2$, derived from oxidation of carbon in the fuel gas, is removed as a substantially pure $CO_2$ product delivered at pressures of about 30 bar (3 MPa) to about 300 bar (30 MPa). The remaining bulk of the $CO_2$ stream is recycled. The key feature of the cycle which allows operation with high thermal efficiency is to supply additional heat to the recycle high pressure $CO_2$ stream at a temperature level below about 400° C. This is necessary because the cycle depends on operation at high pressure in the range of about 200 bar (20 MPa) to about 500 bar (50 MPa) with a relatively low pressure ratio in the range of about 5 to about 12. Under these conditions the specific heat ratio of high to low pressure $CO_2$ increases very significantly as the temperature is reduced down to near ambient in the recuperative heat exchanger. For $CO_2$ at about 300 bar (30 MPa) and about 30 bar (3 MPa) pressure, the specific heat ratio is about 1.032 at about 700° C. and about 1.945 at about 100° C.

High thermal efficiency for the $CO_2$ cycle described above requires a low hot end temperature difference for the recuperative heat exchanger. This can be achieved by introducing additional externally supplied heat at a temperature level below about 400° C. into the high pressure recycle $CO_2$ stream. Previously disclosed methods include firstly using heat derived from the adiabatic compression of air used as air feed to the cryogenic air separation plant and also to adiabatic compression stages in the $CO_2$ recycle compressor prior to cooling and pumping the $CO_2$ to the final high pressure for recycle. Secondly, the heat can be supplied directly to a portion of the high pressure recycle $CO_2$ stream by adiabatic compression after some preheating.

SUMMARY OF THE INVENTION

In one or more embodiments, the present disclosure provides methods for introducing externally supplied heat into the $CO_2$ recycle stream of a power cycle at a temperature level below about 400° C. to give a high thermal efficiency in a simple and cost-effective manner. The present disclosure further provides a power cycle with near 100% $CO_2$ capture, which provides a substantial portion of the heat from the fuel gas for supplying a district heating system with circulating, heated, and pressurized water or low pressure steam to replace the use of natural gas or heating oil for large-scale domestic, commercial, and industrial use with near zero $CO_2$ emission.

The $CO_2$ power cycle described above requires that a significant part of the total heat input should be provided below a temperature level of about 400° C. The quantity of heat provided can be up to about 30% of the total heat input to the cycle. Providing low temperature heat input reduces the hot end temperature difference for the recuperative heat exchanger, increasing the temperature of the recycle $CO_2$ stream entering the combustor, which in turn reduces the quantity of hydrocarbon fuel which must be burned in the oxy-fuel combustor to reach the required turbine inlet temperature of the mixture of preheated recycle high pressure $CO_2$ and the oxy-fuel combustion products.

The present disclosure provides the required low temperature heat input with high thermal efficiency and with no requirement for heat to be supplied from an external source using expensive high pressure heat exchangers and complex high pressure piping systems. This can be achieved by combining the functions of compressing and heating the whole of the circulating $CO_2$ stream, following cooling to near ambient temperature and liquid water separation. The recycle $CO_2$ stream is compressed from the low pressure turbine exhaust system pressure to the high pressure turbine inlet system pressure using an adiabatic compressor. The high pressure $CO_2$ recycle flow leaving the adiabatic compressor is at a high enough temperature to significantly reduce the specific heat ratio of the high and low pressure $CO_2$ streams in the recycle heat exchanger. As an example, the ratio of specific heats of $CO_2$ at about 300 bar (30 MPa)

and about 11 bar (1.1 MPa) are about 2.13 at 50° C. and about 1.17 at 350° C., respectively.

These conditions are close to the actual operating inlet and outlet conditions for an adiabatic $CO_2$ recycle compressor. The adiabatic $CO_2$ recycle compressor provides a high pressure elevated inlet temperature to the recuperative heat exchanger. The inlet temperature depends on the required pressure in the turbine inlet region and the pressure ratio of the adiabatic compressor. The turbine outlet stream leaving the recuperative heat exchanger is cooled in the second heat exchanger, and the cooling means available controls the heat transferred to an external source. The compressor inlet temperature is controlled by an ambient cooling means, such as a direct water cooled heat exchange system upstream of the adiabatic compressor. The ratio of specific heats at the cold end temperature of the recuperative heat exchanger is significantly less than at temperatures below 100° C., which have been used in previous $CO_2$ power cycles. This distinction allows low hot end temperature differences for the recuperative heat exchanger to be easily achieved giving high thermal efficiency for the power cycle without any additional low temperature heating of the high pressure recycle $CO_2$ stream. The turbine exhaust flow leaving the recuperative heat exchanger will be at an elevated temperature. In order to achieve a high overall efficiency for the cycle this heat must be utilized efficiently. At least two possible methods are available and are described herein; however, it is understood that the disclosed methods are example embodiments and may be extended to additional embodiments of the disclosure that are also incorporated in the following discussion.

The first example embodiment is to transfer heat in the second heat exchanger from the turbine exhaust stream leaving the recuperative heat exchanger to an external system which can utilize this heat. One of the best systems would be to provide the heat source for a circulating pressurized water heating system used for domestic, commercial and industrial heating service. District heating systems with circulating pressurized water and/or steam are commonly used in many countries in northern latitudes. Providing this heat would in many cases replace current heating systems using natural gas or oil fuel, and this would remove a significant quantity of $CO_2$ currently being emitted to the atmosphere. A typical water circulation system might provide hot water/steam at a temperature of about 140° C. with a return temperature of about 50° C.

The second embodiment is to transfer heat in the second heat exchanger from the turbine exhaust leaving the recuperative heat exchanger to a steam-based power system producing a superheated high pressure steam flow which would generate power in a condensing steam turbine. Optionally, depending on the temperature level of the turbine exhaust leaving the recuperative heat exchanger, there could be a reheat steam cycle with additional lower pressure steam being reheated prior to expansion to maximize the steam cycle's power output and efficiency. The choice between these two systems is influenced by economic factors. The recuperative heat exchanger preferably will operate with the high pressure recycle $CO_2$ at pressures of about 100 bar (10 MPa) to about 700 bar (70 MPa), about 150 bar (15 MPa) to about 600 bar (60 MPa), or about 200 bar (20 MPa) to about 500 bar (50 MPa). The turbine inlet temperature preferably is in the range of 600° C. to about 1800° C., about 800° C. to about 1700° C., or about 1000° C. to about 1600° C., with higher inlet temperatures giving higher cycle efficiency. Current technology has been developed and commercialized to achieve operation at these higher turbine inlet temperatures using advanced alloys, cooled blades, and protective coatings.

A limitation to operation of a closed cycle $CO_2$ power system is the operating parameters of the recuperative heat exchanger at the hot end conditions. Current approved alloys for the recuperative heat exchanger fabrication limit hot end temperatures to a range from about 600° C. to about 800° C. for recycle $CO_2$ operating pressures of about 500 bar (50 MPa) to about 200 bar (20 MPa). Newer alloys may allow higher operating temperatures in the future. Increasing the turbine inlet temperature for a given inlet pressure will require a higher pressure ratio to meet the temperature limitation and thus a lower outlet pressure as the temperature increases.

As an example, at a turbine inlet condition of about 300 bar (30 MPa) and about 1150° C. and a turbine outlet limit of about 720° C. and with a recuperator hot end temperature difference of about 20° C., the required turbine outlet pressure is about 30 bar (3 MPa). If the turbine inlet condition is about 300 bar (30 MPa) and about 1300° C., the outlet pressure of the turbine needed to maintain the recuperative heat exchanger hot end conditions at about 720° C. turbine outlet and about 20° C. hot end temperature difference is about 12 bar (1.2 MPa). The consequence of this difference is that the adiabatic recycle $CO_2$ compressor has an increased pressure ratio of about 29 at about 1300° C. turbine inlet temperature compared to about 10.5 at a turbine inlet temperature of about 1150° C. This raises the adiabatic compressor outlet temperature and hence raises the temperature of the turbine exhaust leaving the cold end of the recuperative heat exchanger. In the case of the 1300° C. turbine, the adiabatic compressor discharge temperature is about 358° C. With the 1150° C. turbine, the adiabatic compressor outlet temperature is about 240° C. Allowing for about a 10° C. cold end temperature difference for the recuperator heat exchanger, the about 368° C. and about 11 bar (1.1 MPa) $CO_2$ outlet stream can be used to provide heat in the second heat exchanger to produce steam at about 70 bar (7 MPa) pressure superheated to about 360° C. This steam can be used in a steam cycle with a reheat stage at about 20 bar (2 MPa) heated to about 360° C. The thermal efficiency of this cycle will be about 36%.

An attractive alternative is to have a steam turbine which can operate with two stages in series. The first stage is coupled to the second stage via a clutch so that, if required, the second stage can be decoupled from the first stage. The two stages would operate together when maximum power output was required with no hot water production. The first stage alone would be needed when maximum hot water production was required with the second stage decoupled and shut down. The steam leaving the first stage would be at a pressure of about 2 bar (0.2 MPa) to about 10 bar (1 MPa), about 3 bar (0.3 MPa) to about 8 bar (0.8 MPa), or about 4 bar (0.4 MPa) to about 6 bar (0.6 MPa), such as about 5 bar (0.5 MPa) in some embodiments to allow it to condense to heat a circulating water stream from a lower temperature of about 30° C. to about 70° C. or about 40° C. to about 16° C. (e.g., about 50° C.) to a higher temperature of about 120° C. to about 160° C. or about 130° C. to about 150° C. (e.g., about 140° C.). The 1150° C. turbine will not produce a high enough steam temperature and pressure to make it economic to add a steam cycle for extra power generation. The ideal solution for the 1150° C. turbine case is to use all the available heat in the turbine exhaust leaving the recuperative heat exchanger for heating a circulating pressurized water district heating system, replacing current systems which use natural gas or heating oil. It is clear that this version of a typical $CO_2$ power cycle favors the higher turbine inlet temperatures in the range of about 1250° C. to about 1600° C. The decision as to the economic use for the very large quantity of heat available will depend on economic circumstance and available turbine inlet temperature. In general, the adiabatic $CO_2$ compressor inlet pressure will be in the range of about 4 bar (0.4 MPa) to about 30 bar (3 MPa) depending on the turbine inlet conditions. In some circumstances the turbine exhaust leaving the second heat exchanger can be in the temperature range of about 30° C. to about 70° C. or about 40° C. to about 60° C. This heat can be used to preheat the inlet flow to the adiabatic recycle $CO_2$ compressor to achieve a higher discharge temperature. This preheat of the inlet flow to the adiabatic recycle $CO_2$ compressor will increase the adiabatic $CO_2$ recycle compressor power, but in some circumstances, it will beneficially increase the temperature of the turbine exhaust leaving the cold end of the recuperative heat exchanger to allow increased power production or for the generation of high pressure superheated steam for an industrial customer.

BRIEF DESCRIPTION OF THE DRAWINGS

Having thus described the disclosure in the foregoing general terms, reference will now be made to the accompanying drawing, which is not necessarily drawn to scale, and wherein:

FIG. 1 is a flow diagram of an example system and method of power production according to the present disclosure.

DETAILED DESCRIPTION

The present subject matter will now be described more fully hereinafter with reference to example embodiments thereof. These example embodiments are described so that this disclosure will be thorough and complete, and will fully convey the scope of the subject matter to those skilled in the art. Indeed, the subject matter can be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

In various embodiments, the present disclosure describes a power production cycle that provides additional heating for one or more secondary processes. For example, in one embodiment, a power production cycle is described that comprises combusting a carbonaceous or hydrocarbon fuel stream with an oxidant stream to produce combustion products, combining the combustion products with a preheated circulating pressurized $CO_2$ stream to form a mixture, and feeding the mixture to a power turbine to create a discharge, the discharge then being fed into a recuperative heat exchanger to preheat the circulating pressurized $CO_2$ stream, wherein an adiabatic compression system is used to compress the circulating $CO_2$ and oxidant from a turbine discharge pressure region to a turbine inlet pressure region, wherein the $CO_2$ and oxygen streams leaving the adiabatic compression system enter the recuperative heat exchanger where they are heated against a cooling turbine exhaust flow, and wherein turbine exhaust leaving the recuperative heat exchanger enters a second heat exchanger that heats one or more fluid streams supplied from external sources.

A $CO_2$ stream recycled in the combustor can have a pressure of about 100 bar (10 MPa) to about 600 bar (60 MPa) or 200 bar (20 MPa) to about 400 bar (40 MPa) and a temperature of about 400° C. to about 800° C. or about 500° C. to about 700° C. The fuel can be a carbonaceous fuel or a hydrocarbon fuel, but other fuels, such as hydrogen, may also be used. The oxidant can comprise about 15% to about 60% or about 20% to about 40% molar oxygen with the remaining portion formed of a diluent, such as substantially pure $CO_2$. Fuel and oxidant entering the combustor are preferably preheated to a temperature of about 400° C. to about 800° C. or about 550° C. to about 700° C. The combustion product leaving the combustor is at a pressure substantially close to the $CO_2$ recycle inlet pressure and a temperature of about 900° C. to about 1600° C. or about 1100° C. to about 1500° C. and comprises predominately $CO_2$ and $H_2O$ with a small amount of residual oxygen of about 0.10% to about 4.0% molar. The turbine is operated to provide an expanded stream at about 8 bar (0.8 MPa) to about 30 bar (3 MPa) or about 10 bar (1 MPa) to about 20 bar (2 MPa). The expanded stream is cooled in the recuperative heat exchanger to a temperature of about 200° C. to about 600° C. or about 300° C. to about 500° C., and the heat released is transferred to the circulating high pressure $CO_2$ inlet stream. Heat is also provided to the fuel gas inlet stream and the oxidant inlet stream.

The turbine exhaust stream 23 is passed through a heat recovery heat exchanger where it cools to a temperature of about 40° C. to about 80° C., such as about 60° C. in some embodiments, and provides heat to the fuel gas inlet stream and a secondary stream. The secondary stream can be, for example, a boiler feed-water stream at a temperature of about 25° C. to about 80° C. or about 30° C. to about 60° C. and a pressure of about 40 bar (4 MPa) to about 100 bar (10 MPa) or about 60 bar (6 MPa) to about 80 bar (8 MPa), which is heated to produce a superheated steam stream at about 200° C. to about 500° C. or about 300° C. to about 450° C., such as about 360° C. The fuel gas stream is compressed adiabatically to a pressure of about 150 bar (15 MPa) to about 500 bar (50 MPa) or about 250 bar (25 MPa) to about 400 bar (40 MPa). The turbine exhaust leaves the recuperative heat exchanger at a pressure of about 8 bar (0.8 MPa) to about 20 bar (2 MPa) or about 9 bar (0.9 MPa) to about 15 bar (1.5 MPa) and enters a direct contact water cooler. The cooled turbine exhaust stream leaving the top of the water direct contact cooler can be divided in two streams. A first stream can enter the adiabatic compressor where it is compressed to a pressure of about 100 bar (10 MPa) to about 600 bar (60 MPa) or 200 bar (20 MPa) to about 400 bar (40 MPa) and leaves at a temperature of about 250° C. to about 500° C. or about 300° C. to about 450° C. A second stream at about 8 bar (0.8 MPa) to about 15 bar (1.5 MPa), such as about 10.5 bar (1.05 MPa), and a temperature of about 15° C. to about 35° C., such as about 21° C., comprises $CO_2$ derived from combustion of carbon fuel gas. A portion of this stream can be removed from the system for sequestration or other use, and the remaining portion can be mixed with oxygen to for the oxidant for the combustor. The oxidant stream enters an adiabatic compressor where it is compressed to a pressure of about 150 bar (15 MPa) to about 500 bar (50 MPa) or about 250 bar (25 MPa) to about 400 bar (40 MPa).

In some embodiments, the fluid streams heated in the second heat exchanger comprise boiler feed-water and process steam delivered from a steam-based power cycle. In some embodiments, the fluid stream heated in the second heat exchanger comprises a pressurized water flow. In some embodiments, the adiabatic compression system comprises a $CO_2$ compressor and a compressor for an oxidant fluid stream comprising a mixture of oxygen and $CO_2$. In some embodiments, a separate stream of $CO_2$ is taken from the discharge of the $CO_2$ adiabatic compressor and introduced into the power turbine as a cooling fluid.

In some embodiments, the turbine exhaust leaving the second heat exchanger is cooled to near ambient temperature by ambient cooling means, and net product water and $CO_2$ are removed before entering the adiabatic compressors. In some embodiments, the carbonaceous or hydrocarbon fuel stream is preheated in the second heat exchanger and is then heated in the recuperative heat exchanger before it enters the combustor. In some embodiments, the carbonaceous or hydrocarbon stream comprises natural gas, syngas, and/or carbon monoxide that has been compressed to a turbine inlet region pressure. In some embodiments, an inlet pressure of the adiabatic compressor is in the range of about 2 bar (0.2 MPa) to about 60 bar (6 MPa) or about 4 bar (0.4 MPa) to about 40 bar (4 MPa). In some embodiments, a turbine inlet temperature is in the range of about 500° C. to about 1800° C., about 700° C. to about 1700° C., or about 1000° C. to about 1600° C. In some embodiments, a turbine inlet pressure is in the range of about 80 bar (8 MPa) to about 800 bar (80 MPa), about 150 bar (15 MPa) to about 600 bar (60 MPa), or about 200 bar (20 MPa) to about 500 bar (50 MPa). In some embodiments, a pressure ratio of the power turbine is in the range of about 10 to about 60, about 12 to about 50, or about 15 to about 40.

EXAMPLE

Embodiments of the present disclosure are further illustrated by the following example, which is set forth to illustrate the presently disclosed subject matter and is not to be construed as limiting. The following describes an example embodiment of a power production system and method with adiabatic compression, as illustrated in FIG. 1.

The features of the proposed $CO_2$ power cycle with adiabatic compression of the whole recycle $CO_2$ flow, shown in FIG. 1, will be described with an example using methane as the fuel gas, although other fuel sources, such as syngas and/or carbon monoxide, are possible. In some embodiments, the fuel may be supplemented or even replace with hydrogen as reliable sources of hydrogen become available. A $CO_2$ stream 21 at about 305 bar (30.5 MPa) and about 660° C. enters the mixing section of an oxy-fuel combustor 3 where it mixes with the combustion products from a methane stream 18 at about 305 bar (30.5 MPa) and about 550° C. burning in an oxidant stream 20 comprising about 25% molar oxygen mixed with about 75% molar $CO_2$ at about 305 bar (30.5 MPa), which has been heated to about 660° C. Mixing the $O_2$ with $CO_2$ reduces the adiabatic flame temperature in the combustor to a level comparable to that demonstrated using air as the combustion oxidant. Stream 19 at about 300 bar (30 MPa) and about 1300° C. is a mixture of stream 21 and the combustion products, $CO_2$ and $H_2O$, from the oxy-fuel combustor/mixer 3. Stream 19 has about 0.5% to about 2.0% oxygen content to promote complete combustion of the hydrocarbon in the combustor 3. Stream 19 enters a power turbine 2 driving an electrical generator 47 where it expands from about 300 bar (30 MPa) to about 11.2 bar (1.112 MPa) pressure leaving the turbine as stream 22 at a temperature of about 670° C. Stream 22 enters the hot end of a recuperative heat exchanger 4 where it cools to about 379.4° C. leaving as stream 23. The heat released as the turbine discharge flow cools is transferred to the circulating high pressure $CO_2$ inlet stream 24 leaving as stream 21, the oxidant inlet stream 25 leaving as stream 20 and the $CH_4$ fuel gas inlet stream 44 which leaves as stream 18. All three of streams 24, 25, and 44 enter the recuperative heat exchanger 4 at about 357.8° C. The recuperative heat exchanger 4 can be a multichannel compact diffusion bonded heat exchanger such as those manufactured by the Heatric division of Meggitt Ltd. These units use grades of stainless steel and high nickel alloys such Specialty Metals grade 617 alloy depending on the temperature and pressure combination in the heat exchanger.

The turbine exhaust stream 23 is passed through the heat recovery heat exchanger 5 where it cools to about 60° C. leaving as stream 28. The heat released from the cooling turbine exhaust stream in heat exchanger 5 is used to heat the $CH_4$ fuel gas stream 43 at about 305 bar (30.5 MPa) and about 221° C. and an externally supplied stream 26 which leaves as stream 27 at a temperature of about 370° C. The $CH_4$ fuel gas stream 17 enters the power plant from a pipeline at about 15° C. and about 40 bar (4 MPa) pressure. It is compressed adiabatically to about 305 bar (30.5 MPa) in the compressor 1 driven by the motor 9 before entering heat exchanger 5 at an intermediate point. In one embodiment the stream 26 can be a boiler feed-water stream at about 40° C. and typically about 70 bar (7 MPa), which is heated to produce a superheated steam stream at about 360° C. Optionally there can be an additional reheated steam stream heated to about 360° C. (not shown in FIG. 1), which serves to increase the power output and efficiency of the steam power cycle. The heat transferred to the steam power cycle at this temperature level can be converted to power at a thermal efficiency of about 36%.

Alternatively, the excess heat available from the cooling turbine exhaust flow in heat exchanger 5 can be transferred to a circulating pressurized water system used for heating domestic dwellings, hospitals, commercial buildings and for industrial heating applications replacing natural gas and heating oil currently used and avoiding $CO_2$ emissions. A typical system can heat a circulating pressurized water flow from about 50° C. to about 140° C. The turbine exhaust leaves heat exchanger 5 at about 10.7 bar (1.07 MPa) and about 60° C. and enters the direct contact water cooler 13 where it contacts a downward flowing cold water stream 34 in a packed column section 14. The hot water stream 30 leaving the base of the tower divides in to two streams. A product water stream 32, derived from combustion of hydrogen from the $CH_4$ fuel is removed from the system. The remaining bulk of the water stream 31 is pumped in a circulating pump 16 and the discharge stream 33 is then cooled in heat exchanger 15 against cooling water stream 35 at about 19° C. to stream 36 at about 28° C. before entering the top of the packing section 14 as stream 34. The cooled turbine exhaust stream 29 leaving the top of the water direct contact cooler 13 at about 21° C. divides in two streams. Stream 37 enters the adiabatic compressor 11 where it is compressed to about 305 bar (30.5 MPa) leaving as stream 46 at about 357.8° C. Stream 46 divides into stream 45, which enters the power turbine 2 as the internal cooling flow for turbine blades and inner casing and stream 24 which enters the recuperative heat exchanger 4. The adiabatic compressor 11 can, optionally, be directly coupled to the turbine electric generator 47. Stream 38 at about 10.5 bar (1.05 MPa) and about 21° C. divides into two stream. Stream 42 is the net $CO_2$ product derived from combustion of carbon in the $CH_4$ fuel gas. Substantially 100% of the carbon in the total $CH_4$ feed stream 17 is captured in stream 42. The product $CO_2$ stream 42 can be compressed to a convenient pressure in the range of about 100 bar (10 MPa) to about 200 bar (20 MPa) for delivery to a $CO_2$ pipeline for sequestration or alternatively it can be liquefied and delivered as a saturated liquid at about 6 bar (0.6 MPa) to about 7 bar (0.7 MPa) pressure. The remaining $CO_2$ stream 48 is mixed with a 99.5% molar purity $O_2$ stream 39 at about 10.5 bar (1.05 MPa) pressure and about 20° C. from a cryogenic air separation plant 6 to produce an oxidant stream 40 having a molar composition about 25% $O_2$ plus about 75% $CO_2$. Stream 40 enters the adiabatic compressor 10 driven by motor 12 where it is compressed to about 305 bar (30.5 MPa) leaving as stream 25. The cryogenic pumped oxygen air separation plant 6 has an air feed stream 41 compressed to about 5.7 bar (0.57 MPa) pressure in the intercooled compressor 7 driven by motor 8. The compressed air stream 49 enters the air separation area 6 which comprises any of the components necessary for separation of oxygen from air, such as, for example, an air cooler, a dual-bed adsorptive air purifier, a booster air compressor, a cryogenic air separation unit, liquid oxygen pumps, cryogenic refrigeration turbines, and a liquid oxygen storage and back-up system.

A performance summary of example embodiments are shown in Tables 1-3 below (wherein all calculations are based on using pure methane ($CH_4$) as the fuel gas).

TABLE 1

| Parameter | Value |
|---|---|
| Natural Gas Input (40 bar at 15° C.) | 755.6 MW |
| Oxygen Input (99.5 mol % at 20° C. and 10.5 bar (1.05 MPa)) | 5258.4 MT/day |
| $CO_2$ Output (98 mol % at 30° C. and 10.5 bar (1.05 MPa)) | 3580.2 MT/day |
| Turbine Inlet | 1300° C. at 300 bar (30 MPa) |
| Turbine Outlet | 11.2 bar (1.12 MPa) |

TABLE 2

| Parameter | Case 1 Power Production |
|---|---|
| Net Power Output | 463.2 |
| Thermal efficiency (LHV basis) | 61.3% |

TABLE 3

| Parameter | Case 2 Plus District Heating |
|---|---|
| Net Power Output | 350.6 MW |
| Hot water at 140° C. | 312.6 MW |

The terms "about" or "substantially" as used herein can indicate that certain recited values or conditions are intended to be read as encompassing the expressly recited value or condition and also values that are relatively close thereto or conditions that are recognized as being relatively close thereto. For example, unless otherwise indicated herein, a value of "about" a certain number or "substantially" a certain value can indicate the specific number or value as well as numbers or values that vary therefrom (+ or −) by 5% or less, 4% or less, 3% or less, 2% or less, or 1% or less. Similarly, unless otherwise indicated herein, a condition that substantially exists can indicate the condition is met exactly as described or claimed or is within typical manufacturing tolerances or would appear to meet the required condition upon casual observation even if not perfectly meeting the required condition. In some embodiments, the values or conditions may be defined as being express and, as such, the term "about" or "substantially" (and thus the noted variances) may be excluded from the express value.

Many modifications and other embodiments of the presently disclosed subject matter will come to mind to one skilled in the art to which this subject matter pertains having the benefit of the teachings presented in the foregoing descriptions and the associated drawings. Therefore, it is to be understood that the present disclosure is not to be limited to the specific embodiments described herein and that modifications and other embodiments are intended to be included within the scope of the appended claims. Although specific terms are employed herein, they are used in a generic and descriptive sense only and not for purposes of limitation.

The invention claimed is:

1. A power production cycle comprising:

combusting a hydrocarbon fuel stream with an oxygen stream to produce combustion products;

combining the combustion products with a preheated circulating pressurized $CO_2$ stream to form a mixture; and feeding the mixture to a power turbine to create a discharge, the discharge then being fed into a recuperative heat exchanger to preheat the circulating pressurized $CO_2$ stream, wherein an adiabatic compression system is used to compress the circulating pressurized $CO_2$ stream and oxygen from a turbine discharge pressure region to a turbine inlet pressure region, wherein the circulating pressurized $CO_2$ stream and oxygen leaving the adiabatic compression system enter the recuperative heat exchanger where they are heated against a cooling turbine exhaust flow, wherein turbine exhaust leaving the recuperative heat exchanger enters a second heat exchanger that heats one or more fluid streams supplied from external sources; and further comprising preheating the hydrocarbon fuel stream in the second heat exchanger and then heating the hydrocarbon fuel stream in the recuperative heat exchanger before combusting the hydrocarbon fuel stream.

2. The power production cycle according to claim 1, wherein the fluid streams heated in the second heat exchanger comprise boiler feed-water and process steam delivered from a steam-based power cycle.

3. The power production cycle according to claim 1, wherein the one or more fluid streams heated in the second heat exchanger comprises a pressurized water flow.

4. The power production cycle according to claim 1, wherein the adiabatic compression system comprises a $CO_2$ compressor and a compressor for an oxidant fluid stream comprising a mixture of oxygen and $CO_2$.

5. The power production cycle according to claim 4, wherein a separate stream of $CO_2$ is taken from the discharge of the $CO_2$ compressor and introduced into the power turbine as a cooling fluid.

6. The power production cycle according to claim 1, wherein the turbine exhaust leaving the second heat exchanger is cooled to near ambient temperature by ambient cooling means, and wherein net product water and $CO_2$ are removed before entering the adiabatic compression system.

7. The power production cycle according to claim 1, wherein the hydrocarbon fuel stream comprises natural gas that has been compressed to a turbine inlet region pressure.

8. The power production cycle according to claim 1, wherein an inlet pressure of the adiabatic compression system is in a range of about 4 bar (0.4 MPa) to about 40 bar (4 MPa).

9. The power production cycle according to claim 1, wherein a turbine inlet temperature is in a range of about 1000° C. to about 1600° C.

10. The power production cycle according to claim 1, wherein a turbine inlet pressure is in a range of about 200 bar (20 MPa) to about 500 bar (50 MPa).

11. The power production cycle according to claim 1, wherein a pressure ratio of the power turbine is in a range of about 15 to about 40.

* * * * *